US006227167B1

(12) United States Patent
Smith et al.

(10) Patent No.: US 6,227,167 B1
(45) Date of Patent: May 8, 2001

(54) SUCTION CONTROLLED PUMP FOR HEUI SYSTEMS

(75) Inventors: Brian William Smith, Wooster; Eric D. Ramseyer, Orrville; Mark Douglas Smith, Bellville, all of OH (US)

(73) Assignee: Mannesmann Rexroth Corporation, Wooster, OH (US)

( * ) Notice: Subject to any disclaimer, the term of this patent is extended or adjusted under 35 U.S.C. 154(b) by 0 days.

(21) Appl. No.: 09/553,285

(22) Filed: Apr. 20, 2000

(51) Int. Cl.[7] ..... F02M 37/04; F04B 1/12

(52) U.S. Cl. ..... 123/446; 123/506; 417/269

(58) Field of Search ..... 123/495, 497, 123/446, 506; 417/269, 490

(56) References Cited

U.S. PATENT DOCUMENTS

| | | | | |
|---|---|---|---|---|
| 5,191,867 | | 3/1993 | Glassey . | |
| 5,515,829 | | 5/1996 | Wear et al. . | |
| 5,788,469 | | 8/1998 | Novacek et al. . | |
| 5,809,863 | * | 9/1998 | Tominaga et al. | 417/269 |
| 5,957,111 | | 9/1999 | Rodier . | |
| 6,035,828 | * | 3/2000 | Anderson et al. | 123/446 |
| 6,036,448 | * | 3/2000 | Fiddes | 417/269 |
| 6,074,175 | * | 6/2000 | Hoshi et al. | 417/269 |

OTHER PUBLICATIONS

SAE Technical Paper Series 2000–01–0687; "Development of a Variable–Displacement, Rail–Pressure Supply Pump for Dimethyl Ether"; James C. McCandless, Ho Teng and Jeffrey B. Schneyer, AVL Powertrain Technologies, Inc.; SAE World Congress, Detroit, MI; Mar. 6–9, 2000.

* cited by examiner

*Primary Examiner*—Thomas N. Moulis
(74) *Attorney, Agent, or Firm*—Frank J. Nawalanic

(57) ABSTRACT

A HEUI system uses a fixed displacement, axial displacement pump to provide a generally constant pump flow of high pressure hydraulic fluid over the operating speed range of the pump to minimize parasitic power drains on the engine. The axial piston pump includes a orificing suction slot to vary the pump displacement over the operating speed of the pump. A throttling valve at the pump inlet may be provided to starve inlet fluid feed if reduced flow to the injectors is additionally required.

22 Claims, 7 Drawing Sheets

SUCTION CONTROLLED PUMP FOR HEUI SYSTEMS

This invention relates generally to axial piston pumps and more particularly to a high pressure pump used in a hydraulically actuated electronically controlled unit injector (HEUI) fuel control system.

The invention is particularly applicable to and will be described with specific reference to a constant flow, fixed displacement pump and the integration of the fixed displacement pump into a HEUI system. However, those skilled in the art will appreciate that the invention may have broader application and may be integrated into other hydraulic pump driven systems, such as vehicular steering systems.

INCORPORATION BY REFERENCE

The following United States patents are incorporated by reference herein and made a part hereof so that details of pumps and HEUI systems conventionally known in the art need not be repeated herein.

- U.S. Pat. No. 5,957,111, to Rodier, issued Sep. 28, 1999, entitled "METHOD OF REGULATING SUPPLY PRESSURE IN A HYDRAULICALLY-ACTUATED SYSTEM";
- U.S. Pat. No. 5,515,829, to Wear et al., issued May 14, 1996, entitled "VARIABLE-DISPLACEMENT ACTUATING FLUID PUMP FOR A HEUI FUEL SYSTEM";
- U.S. Pat. No. 5,191,867, to Glassey, issued Mar. 9, 1993, entitled "HYDRAULICALLY-ACTUATED ELECTRONICALLY-CONTROLLED UNIT INJECTOR FUEL SYSTEM HAVING VARIABLE CONTROL OF ACTUATING FLUID PRESSURE"; and,
- U.S. Pat. No. 5,788,469 to Novacek et al., issued Aug. 4, 1998, entitled "PISTON TYPE LIQUID FUEL PUMP WITH AN IMPROVED OUTLET VALVE".

None of the patents incorporated by reference herein form any part of the present invention.

BACKGROUND

As is well known, a hydraulically-actuated electronically-controlled unit injector fuel system has a plurality of injectors, each of which, when actuated, meters a quantity of fuel into a combustion chamber in the cylinder head of the engine. Actuation of each injector is accomplished through valving of high pressure hydraulic fluid within the injector under the control of the vehicle's microprocessor based electronic control module (ECM).

Generally, sensors on the vehicle impart engine information to the ECM which develops actuator signals controlling a solenoid on the injector and the flow of hydraulic fluid to the injector. The solenoid actuates pressure balanced poppet valves (as shown in the '867 and '829 patents) in the injector to port high pressure fluid to an intensifier piston which causes injection of the fuel at very high pressures. The pressure at which the injector injects the fuel is a function of the hydraulic fluid flow supplied the injector by a high pressure pump while the timing of the injector is controlled by the solenoid. Both functions are controlled by the ECM to cause precise pulse metering of the fuel at desired air/fuel ratios to meet emission standards and achieve desired engine performance. Tightening emission standards and a demand for better engine performance have resulted in continued refinement of the control techniques for the injector. Generally the pump flow output has to be variable throughout the operating range of the engine. For example, one manufacturer may desire a constant pump flow throughout an operating engine speed range except at the higher operating engine speeds whereat the injectors are valving so quickly reduced pump flow may be desired even though more fuel is being injected by the injectors to the combustion chambers. Other manufacturers may desire to rapidly change pump flow at any given instant for emission control purposes. For example, the ECM may sense a step load change on the engine and impose a change in the fuel/air ratio to overcome the effects of a transient emission.

High pressure hydraulic actuating fluid is supplied to each injector by a high pressure pump in fluid communication with each injector through a manifold/rail fluid passage arrangement. As noted in the '867 patent, the high pressure pump is either a fixed displacement, axial piston pump or alternatively a variable displacement, axial piston pump. If a fixed displacement pump is used, a rail pressure control valve is required to variably control the pressure in the manifold rail by bleeding a portion of the flow from the high pressure pump to a return line connected to the engine's sump. For example, the '867 patent mentions varying the output of the high pressure pump by the rail pressure control valve to pressures between 300 to 3,000 psi. A variable displacement pump can eliminate the rail control valve if the flow output of the variable pump can timely meet the response demands imposed by the HEUI system.

A fixed displacement, high pressure pump is typically used in HEUI systems because of cost considerations. The pump is sized to match the system it is applied to. It is well known that the flow of a fixed displacement pump increases, generally linearly, with speed. Accordingly, the fixed displacement pump is sized to meet HEUI system demands at a minimal engine speed which is less than the normal operating speed ranges of the engine. Higher engine speeds produce excess pump flow which is dumped by the rail pressure control valve to return. The excess flow represents an unnecessary power or parasitic drain on the engine which the engine manufacturers have continuously tried to reduce.

For example, the '111 patent shows a control scheme in which excess pump flow is passed to an idle injector but at a rate insufficient to actuate the injector. The system is stated to allow elimination of the rail pressure control value and permit a more accurate sizing of the fixed displacement pump. However, the system does not avoid unnecessary parasitic engine power drains imposed by the pump. The pump must still be sized to produce a set flow sufficient to actuate the injectors at a low speed and that flow increases with pump speed.

The prior art has also developed variable output pumps for use in a HEUI system as disclosed, for example, in the '829 patent. Variable output, axial piston pumps do not have the reliability of a fixed displacement, axial piston pump and are more expensive. More significantly, the response time demands for pump output flow in a HEUI system is becoming increasingly quicker and a variable pump may be unable to change output flow within the time constraints of a HEUI system unless a rail pressure control valve is used.

SUMMARY OF THE INVENTION

It is therefore a principal object of the invention to provide a fixed displacement, axial flow pump which can be sized for a HEUI or other hydraulic system to alleviate or minimize engine power or parasitic drains imposed on the engine attributed to the associated bleeding of excess capacity pump flow.

This object along with other features of the invention is achieved by a constant flow, fixed displacement, axial piston pump which includes a non-rotatable cylinder containing a plurality of piston bores circumferentially spaced about a longitudinal centerline of the pump. A rotatable shaft concentric with the pump's longitudinal centerline and having a swash plate affixed or integral therewith is journalled in the pump. Within each bore a piston is axially movable and has one end extending through a bore end and journalled in a slipper in sliding contact with the swash plate while the piston's opposite end is adjacent an outlet check valve at the opposite bore end. The pump has a discharge chamber in fluid communication with all piston outlet check valves and with the pump outlet. Each piston bore has suction slot of set area in fluid communication with the pump inlet which is sized as a function of timed flow through an orifice. The suction slot is transversely positioned at a set distance between the piston bore ends and sealed and opened by axial movement of each piston within its bore whereby fluid displaced into the piston bore decreases during the piston suction stroke in fixed relationship to increases in shaft rotational speed after the operating speed of the pump has been reached to produce a constant displacement pump throughout the operating speed range of the pump.

An important feature of the invention is achieved by an improvement to an internal combustion engine having a hydraulically actuated, electronically controlled fuel injection system of the type including a fuel injector valving high pressure fluid in response to commands from an ECM to timely inject a metered quantity of fuel to the engine's combustion chamber. The injector is in fluid communication with the outlet of the high pressure pump which in turn has an inlet in fluid communication with a low pressure pump. The improvement includes an axial piston, fixed displacement high pressure pump, as described above, which produces a constant output flow of fluid at all operating speeds of the pump whereby the pump can be sized to match the flow demands of a HEUI system without placing excessive or unneeded power demands on the engine.

In accordance with another important aspect of the invention, the improved system includes the provision of a pressure control throttling valve at the inlet of the high pressure pump whereby the generally constant high pressure flow from the high pressure pump can be reduced to lower displacement flow values in response to commands from the ECM without placing any load on the engine to develop a pump pressure higher than what is required to actuate the HEUI system.

In accordance with another aspect of the invention, an annular discharge chamber is in fluid communication with the outlet check valve and the outlet port of the pump. The outlet check valve may be a reed flapper valve whereby high pressure fluid pumped by all cylinders in the pump is united in the discharge chamber to dissipate pump pulsations.

In accordance with a still further aspect of the invention, the high pressure pump has a housing defining chamber therein and the cylinder is fixed to the housing which also journals the rotatable shaft therein. The housing also has an annular inlet chamber in fluid communication with the bore slots and a drain passage is provided for fluid communication between the housing chamber and the inlet chamber whereby internal pump leakage is drained through the pump inlet avoiding external pump drain lines when the pump operates in a hydraulic system where the pump inlet is not pressurized.

It is an object of the invention to provide a fixed displacement axial piston pump having generally constant output flow throughout its operating speeds.

It is a primary object of the invention to provide a fixed displacement pump for use in any vehicular hydraulic system driven by the vehicle's engine which reduces or minimizes the power drain imposed by the pump on the engine.

It is another object of the invention to provide a fixed displacement pump for use in a HEUI system which provides a constant flow of pressurized fluid over the operating range of the pump to allow a better and/or more consistent control of the injector over the operating range of the engine.

It is another object of the invention to provide a hydraulic circuit for actuating a hydraulically actuated electronically controlled fuel injector which delivers constant pump flow over an operating pump speed range with an ability to throttle the flow on demand while decreasing power demands of the pump on the engine.

Still yet another object of the invention is to provide a fixed displacement pump for use in a HEUI system which alleviates the need for a rail pressure control valve, or, alternatively, allows for use of a smaller, less expensive rail pressure control valve.

Still yet another object of the invention is to provide a fixed displacement axial flow pump which is able to provide fluid to a hydraulically actuated, electronically controlled fuel injector that simulates or improves upon the performance level achieved by a variable displacement pump.

Still yet another object of the invention is to provide an improved low cost high pressure pump for use in an HEUI system.

A still further general object of the invention is to provide a fixed displacement pump producing a constant flow of pressurized hydraulic fluid over an operating speed range of the pump for use in any number of vehicular hydraulic systems which use the power from the engine to control the hydraulic system.

These and other objects, features and advantages of the invention will become apparent to those skilled in the art upon reading and understanding the Detailed Description of the Invention set forth below.

BRIEF DESCRIPTION OF THE DRAWINGS

The invention may take form in certain parts and arrangement of parts, a preferred embodiment of which will be described in detail and illustrated in the accompanying drawings which form a part hereof and wherein.

DETAILED DESCRIPTION OF THE INVENTION

Figure 1:
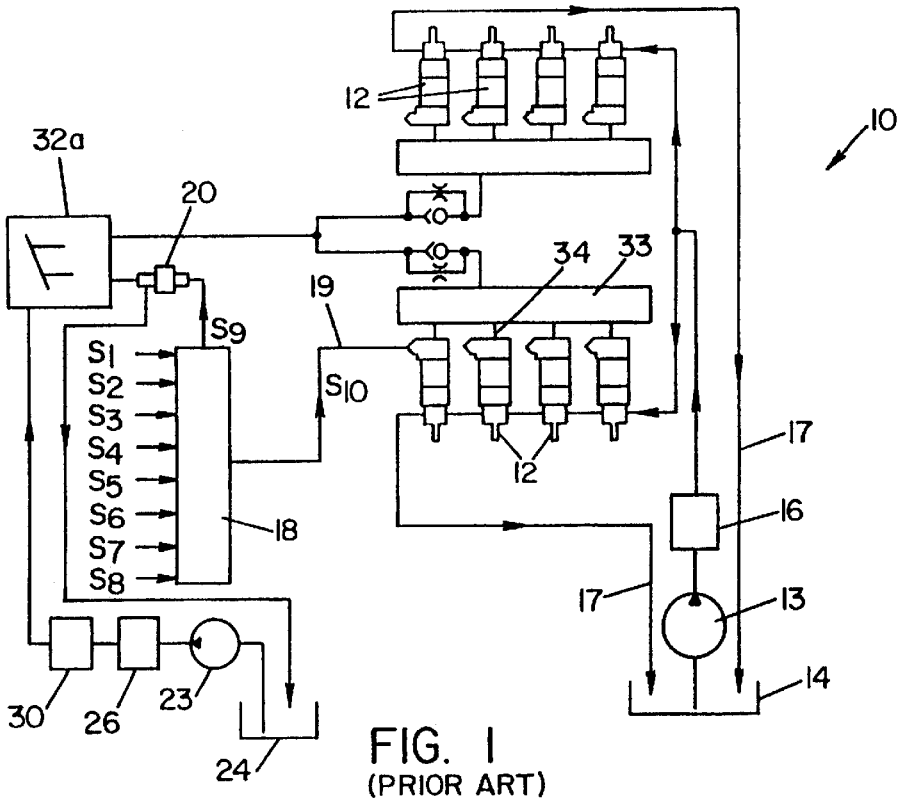
FIG. 1 (PRIOR ART)
FIG. 1 is a prior art schematic illustration of a HEUI fuel injection system.
Figure 2:
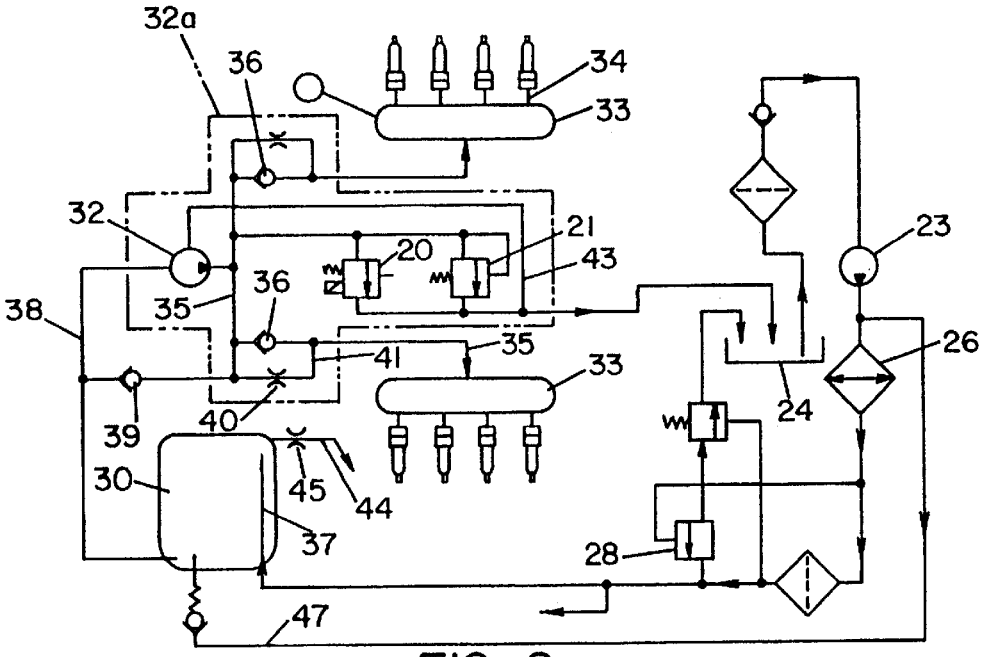
FIG. 2 (PRIOR ART)
FIG. 2 is a prior art schematic hydraulic actuating fluid circuit diagram for the injection system shown generally in FIG. 1.

Referring now to the drawings wherein the showings are for the purpose of illustrating a preferred embodiment of the invention only and not for the purpose of limiting the same, reference is first had to a description of a prior art HEUI system as shown in FIGS. 1 and 2 since the present invention may be perhaps best explained by reference to an existing arrangement. The system shown in FIGS. 1 and 2 will only be described in general terms and reference should be had to the patents incorporated by reference herein for a more detailed explanation of the system including the operation of the fuel injector, per se, which is not shown in detail herein.

Referring first to prior art FIG. 1, there is diagrammatically shown an HEUI fuel injection system 10 which includes a plurality of unit fuel injectors 12. A fuel pump 13 draws fuel from the vehicle's fuel tank 14 and conditions the fuel at a conditioning station 16 before pumping the fuel to individual injectors 12 as shown. One or more fuel return lines 17 is provided. The fuel supply system as shown is separate and apart from the hydraulic system which actuates fuel injectors 12. It is understood that the engine fueled by injectors 12 is typically a diesel engine and that diesel fuel (fuel oil) can be optionally used as the fluid to power injectors 12. See the '867 patent. In the preferred embodiment, engine oil is used to actuate injectors 12. Those skilled in the art will recognize that the present invention is functional in those systems which use diesel fuel pumped under high pressure to actuate injectors 12.

Fuel injectors 12 are actuated by hydraulic pressure which, in turn, is regulated by signals generated by an electronic control module, ECM 18. ECM 18, in response to a number of sensed variables, generates electrical control signals which are inputted at 19 to a solenoid valve in each fuel injector 12 and to a rail pressure control valve 20 which determines the pressure of engine oil pumped to fuel injectors 12 by a high pressure pump 32.

More particularly, ECM 18 receives a number of input signals from sensors designated as S1 through S8. The sensor signals represent any number of variables needed by ECM 18 to determine fueling of the engine. For example, input signals can include accelerator demand or position, manifold air flow, certain emissions sensed in the exhaust, i.e., HC, CO, NOx, temperature, engine load, engine speed, etc. In response to the input signals, ECM accesses maps stored in look-up tables and performs algorithms, also stored in memory, to generate a fueling signal on S9 which is inputted as an electrical signal to rail pressure control valve 20 and a signal on S10 which takes the form of an electrical signal actuating a solenoid in injector 12. Injector 12 is entirely conventional and can take any one of a number of known forms. Reference can be had to the injectors shown in the '829 and '867 patents, incorporated by reference herein and made a part hereof, for a more detailed explanation of the workings of the injectors. For purposes of this invention, it is believed sufficient to state that high pressure fluid from a high pressure pump is supplied to the injectors. The pump fluid, which is supplied injectors 12 is, in the preferred embodiment, engine oil and drains from the injectors back to the engine sump (oil pan) through the engine's case (valve housing). Generally, pressure balanced poppet valves actuated by the solenoid, direct high pressure pump fluid against a pressure intensifier within injector 12. The pressure intensifier pressurizes diesel fuel to very high pressures (as high as 20,000 psi while high pressure pump pressure is not higher than about 4,000 psi) and ejects a pulse of fuel on this high pressure into the engine's combustion chamber. Poppet valve design, the staging or sequencing of the poppet valves, the degree of solenoid actuation, etc. will vary from one engine manufacturer to the next to generate a particular fuel pulse matched to the ignition/combustion characteristics of the combustion chamber formed by the geometry of the engine's piston/cylinder head. Various pulses such as square, sine, skewed, etc. can be developed by the injector 12 in response to solenoid signals from ECM 18.

As noted in the Background, the HEUI system has enjoyed its widespread acceptance because its operation is not affected by the speed or load placed on the engine. However, the HEUI system requires high pressure actuating fluid to operate and the flow rate of the fluid has to be variable on demand to produce the desired feed pulse from the injector. Again, how the pulse is developed is beyond the scope of this invention. It is sufficient for an understanding of the present invention to recognize that the pump supplying actuating fluid to the injectors must achieve a minimum flow rate which allows the injector to achieve maximum fuel pressure. Once the high pressure pump achieves this output, the HEUI system, through rail pressure control valve (RPCV) 20 may reduce the pump flow on demand for any number of reasons to produce a desired fuel pulse. For example, one engine manufacturer may desire a constant pump flow through the operating range except that at high operating engine speeds, the poppet valves within injectors 12 may cycle so quickly that it is desirable for pump flow to be reduced. That is the pressure of the fluid can be transferred instantaneously before the hydraulic fluid drain through the injector "catches up". Anther manufacturer may sense load changes imposed on the engine and throttle the high pressure pump flow, at any engine operating speed, for emission purposes. In conventional systems, high pressure pump 32 supplies excess flow to injectors 12 which excess flow is returned to drain through RPCV 20 and the excess flow continues to increase as the pump speed increases. While rail pressure control valve 20 has been refined to timely respond to ECM demands, it should be clear that if the pump's excess flow can be reduced to more closely model system flow demands, the size (and expense) of rail pressure control valve 20 can be reduced.

As shown in prior art FIGS. 1 and 2, oil from the vehicle's conventional oil pump or low pressure pump 23 is cooled by a conventional radiator core 26. A low pressure oil stream produced by a pressure valve 28 fills a priming reservoir 30 which is in fluid communication with the inlet end of a high pressure pump 32. High pressure pump 32 includes the components shown in FIG. 2 within dot-dash line indicative of pump housing 32*a*. High pressure pump 32 pressurizes the engine oil at the high pressure pump's outlet (now termed actuating oil) which is in fluid communication with common rail passage 33 in the manifold which, in turn, is in fluid communication with rail branch passages 34 leading to actuating ports within individual fuel injectors 12. In the prior art arrangement shown in FIGS. 1 and 2, a vee-type engine is used so there are two manifolds and two sets of rails. Also, for convenience in notation, reference to "rail"

means the common rail passage 33 and rail branch passages 34 and can optionally include the actuating oil supply line 35 leading from the outlet of high pressure pump 32 to the manifold. When high pressure pump 32 is operating, pressure of the actuating oil in manifold/rail passages 33, 34 as noted above is determined by the actuation of rail pressure control valve 20 which is backed up with a safety relief valve 21.

Referring now to prior art FIG. 2, priming reservoir 30, in addition to functioning as an oil reservoir supplying oil to the inlet of high pressure pump 32, functions also as a reservoir to maintain oil in the high pressure pump inlet supply line 38 and oil in high pressure pump 32 as well as oil in the manifold/rail passages 33, 34 when high pressure pump 32 doesn't operate. This is achieved by physically positioning priming reservoir 30 at an elevation above the inlet port of high pressure pump 32 and above manifold/rail passages 33, 34 and specifically, the use of a stand pipe 37 at that elevation to establish a gravity flow from priming reservoir 30. Make-up oil flows past a one way check valve 39 (oil ferry) through an optional flow restriction orifice 40 in a bypass line 41 which communicates with actuating supply line 35. Orifice 40 in combination with check valves 36 also functions to control Helmholtz resonance for balancing pressure surges or waves between the two manifolds for the vee-type engine illustrated. The make-up oil from priming reservoir 30 thus flows to the actuating supply line 35 and then to manifold/rail passages 33, 34. Make-up oil also flows through actuating supply line 35 to the outlet of high pressure pump 32. Leakage within high pressure pump 32 returns to crank case sump 24 through a fluid leakage supply line 43. When priming reservoir 30 is filled by low pressure pump 23 excess oil and air is vented for return to crank case sump 24. In the prior art FIG. 2 this occurs through an overflow return line 44 which includes an orifice 45 to maintain a slight pressure in priming reservoir 30. It is or should be clear that in the system embodiment shown in FIGS. 1 and 2, the inlet of high pressure pump 32 during engine operation is charged through reservoir 30 at the pressure of low pressure pump 23. The invention will function in hydraulic systems that do not pressurize the inlet part of high pressure pump 32.

Figure 3:
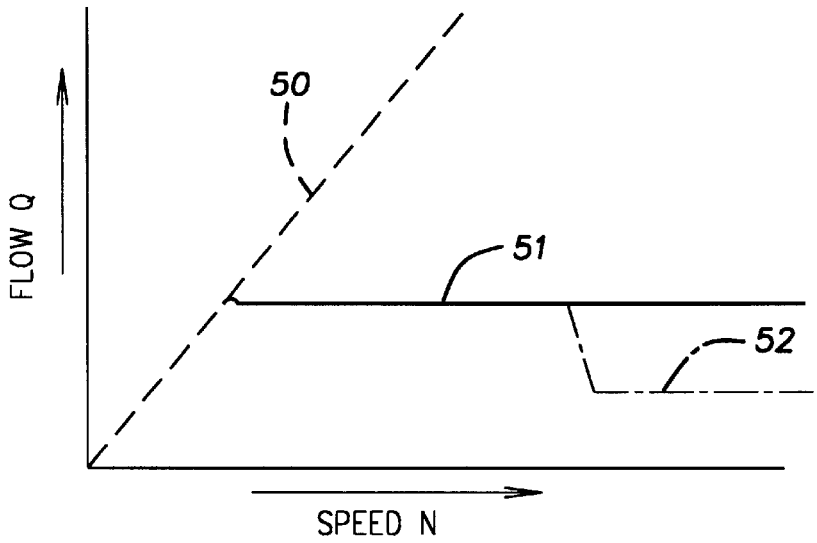
FIG. 3 is a constructed graph of pump flow versus speed for a conventional fixed displacement pump and for the fixed displacement pump of the present invention.

Referring now to FIG. 3, there is shown a constructed graph plotting pump speed along the x-axis and pump flow along the y-axis for a fixed displacement pump. As is well known, pump flow increases, generally linearly, as a function of pump speed for a fixed displacement pump as shown by the dotted trace 50. For reasons which will be explained in detail below, pump 55 of the present invention operates as a conventional fixed displacement pump in the sense that increasing pump speed increases pump flow. However, in the present invention, when a pump critical speed, hereinafter termed "operating speed", is reached, the pump flow is constant notwithstanding increases in pump rotational speed. The operating speed of pump 55 of the present invention is shown by the solid line indicated by reference numeral 51. Further, for reasons discussed below it is possible for the pump flow of pump 55 to be decreased at any operating pump speed and this is indicated by dot-dash line 52 in FIG. 3.

Figure 4:
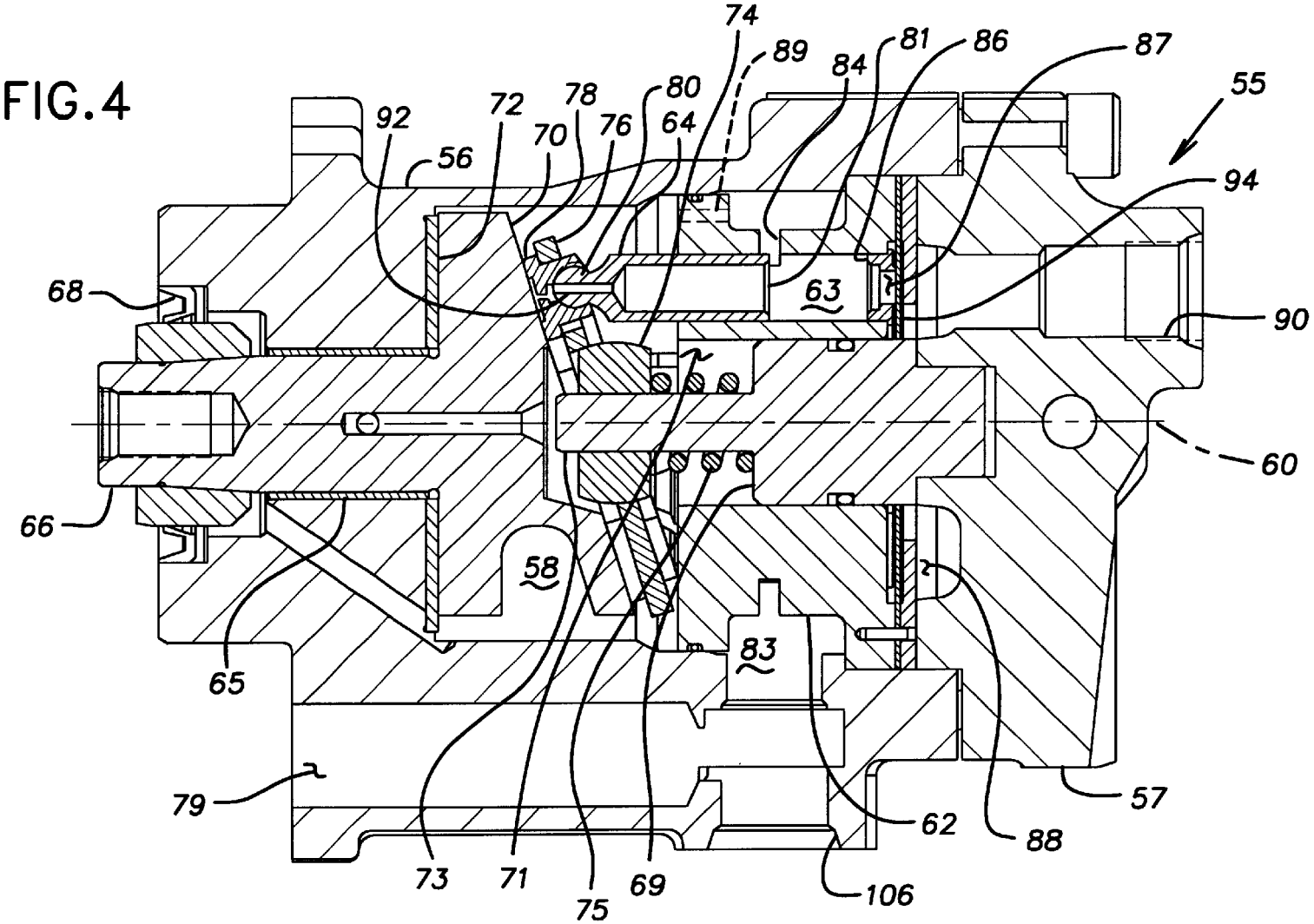
FIG. 4 is a sectioned side elevation view of the fixed displacement pump used in the present invention.
Figure 4A:
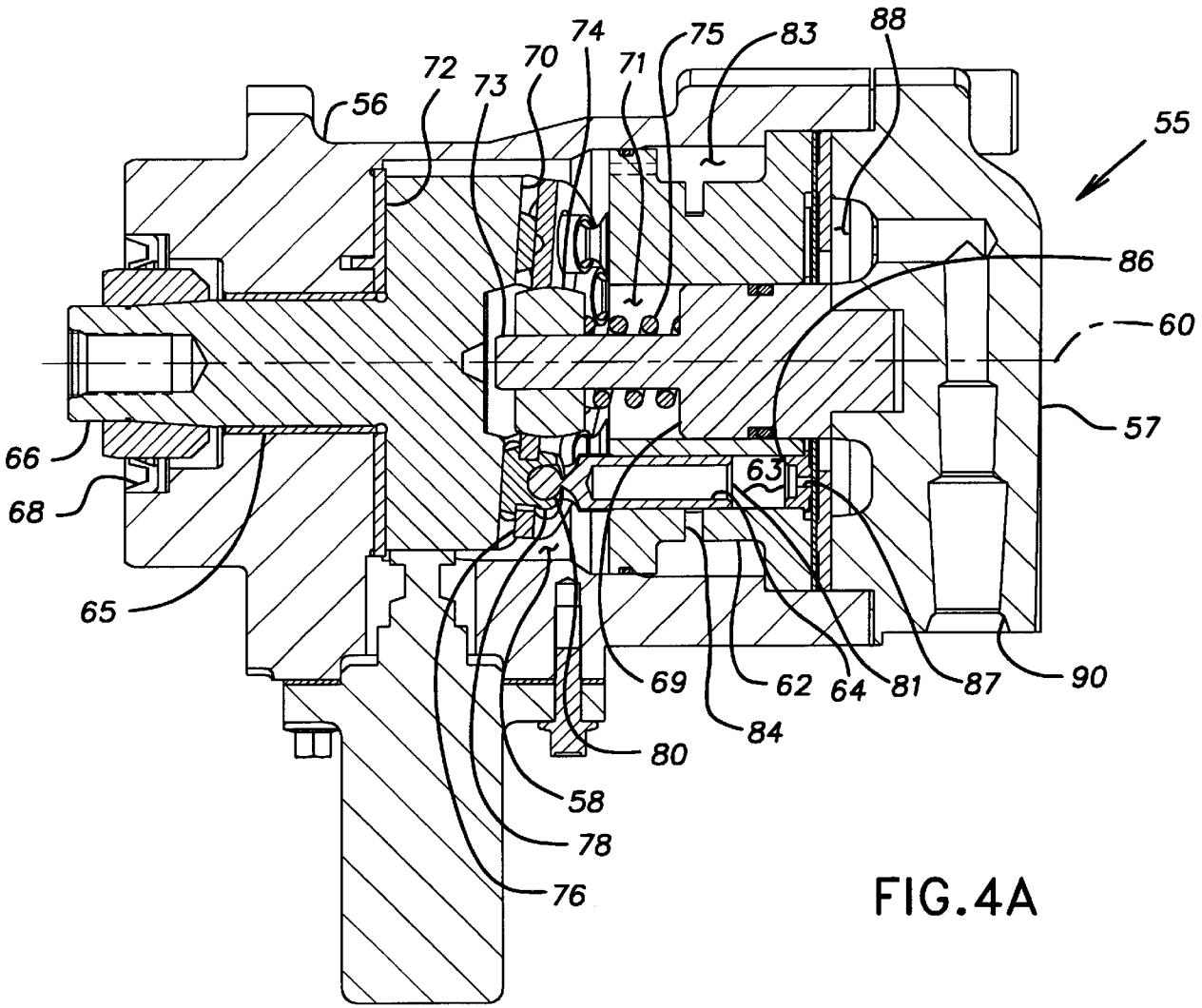
FIG. 4A is a sectioned elevation view similar to that shown in FIG. 4 but through a section about 90° to the pump section shown in FIG. 4.

Referring now to FIGS. 4 and 4A, high pressure fixed displacement axial piston pump 55 includes a pump body 56 which is sealing secured to an end body casting 57 to define a body chamber 58 extending along pump centerline 60. Fixed to pump body 56 and end body casting 57 is a piston cylinder 62 containing a plurality of piston bores 63 circumferentially spaced about pump centerline 60. Disposed and axially movable within each piston bore 63 is a piston 64.

Journalled within body chamber 58, as by a sleeve bushing 65, is a gear driven shaft 66. Shaft 66 is rotatably sealed within body chamber 58 by a shaft seal 68 at one end. A portion of shaft 66 is formed as a swash plate 70, one end of which contacts a thrust bearing 72. Alternatively, swash plate is affixed or keyed to shaft 66 so as to be rotatable therewith. A tail shaft 69, longitudinally extending along centerline 60, is received within a central opening 71 extending through piston cylinder 62 and seated against a central recess in end body casting 57. Tail shaft 69 has a necked down stem portion 73 extending out of central opening 71 which receives a spherical bearing 74. Spherical bearing 74 is biased by a spring 75 in a direction that pushes spherical bearing 74 off stem 73 and is retained in the assembled position shown in FIGS. 4 and 4A because it engages, at its spherical bearing surface, a central opening in a slipper retainer plate 76. The circular central opening in slipper retainer plate 76 has a diameter less than the outside spherical diameter of spherical bearing 74. Slipper retainer plate 76 has circumferentially spaced, radially outward openings that receive and maintain socket shaped slippers 78 in contact with swash plate 70 and each piston 64 has a ball end 80 received within the socket of an associated slipper 78. Thus, pistons 64, which are fixed (although longitudinally movable) vis-a-vis stationary piston cylinder 62, likewise fix slippers 78 vis-a-vis the ball/socket connection which in turn fix the position of slipper retainer plate 76 and slipper retainer plate 76 prevents spherical bearing 74 from leaving stem portion 73 under the bias of spring 75. Spring 75 thus maintains, through the connections described, slippers 78 in contact with swash plate 70 while slipper retainer plate 76 pivots or swivels about spherical bearing 74 upon rotation of swash plate 70 relative to piston cylinder 62. Note that while tail shift 69 is not rotated by gear driven shaft 66, tail shaft 69 and the opening in spherical bearing 74 which receives stem portion 73 are cylindrical in the preferred embodiment. This may enhance the swivel/pivoting motion of slipper retainer plate 76 relative to spherical bearing 74. Other arrangements can be employed to allow rotation of swash plate 70 relative to fixed piston cylinder 62 while maintaining a spring bias against spherical bearing 74. However, the general arrangement of slipper retainer 76/spherical bearing 74 with the spherical bearing spring biased to a set axial position by spring 75 centered on centerline 60 produces a stable arrangement allowing for smooth axial motion of pistons 64 throughout the speed ranges of pump 55. Other arrangements, such as that shown in the '469 patent, use offset varying spring forces in the piston bore to maintain slipper/swash plate contact.

As described thus far, pump 55 is different from typical axial piston pumps in which the cylinder rotates relative to a stationary swash plate. In pump 55, rotation of swash plate 70 causes piston 64 to axially move in bore 63 through spherical bearing 74, retainer plate 76 and slippers 78/piston ball end 80. For definition, rearward (toward the left when viewing FIG. 4) movement of piston 64 out of bore 63 at the ball end 80 side of piston 64 is a "suction stroke" of piston 64 while forward (towards the right when viewing FIG. 4) movement of piston 64 into piston bore 63 produces a "compression stroke" of piston 64. Movement of piston 64, caused by relative rotation of swash plate 70 and piston 62, is conventional, although typically swash plate 70 is stationary.

Adjacent the forward end 81 of piston 64, a vent insert 86 is inserted at the discharge end of piston bore 63. Vent insert 86 has a vent orifice 87 formed therein which communicates through a one-way check valve with an annular discharge chamber 88 formed in end body casting 57 which in turn is in fluid communication with a pressurized outlet port 90 of pump 55. Unlike traditional axial piston pumps, there are no kidney shaped inlet and outlet passages in fluid communication with the piston bore vent orifice as the piston cylinder rotates to sequentially communicate the vent orifice with a kidney shaped inlet passage during the piston's suction stroke and with a kidney shaped outlet passage during the piston's compression stroke. In the traditional axial piston pump, when the piston bores rotate to switch the inlet kidney shaped passage to the outlet kidney shaped passage, the bores pass over lands which produce or contribute to pulsation of the fluid, especially at high pump speeds. This is avoided or minimized in pump 55 by having all piston bores 63 communicate through a check valve with a common annular discharge chamber 88 which unites or unifies the flow from piston bore 63 during the compression stroke of piston 64 while the check valve prevents flow of fluid from annular chamber 88 into piston bore 63 during the suction stroke of piston 64. While annular discharge chamber 88 could be a centrally positioned chamber and relatively large such as disclosed in the '469 patent, preferably, it is ring shaped and in the nature of a passageway, as shown in FIG. 4, which has been found to produce consistent, somewhat non-pulsing flow through outlet port 90.

Figure 6:
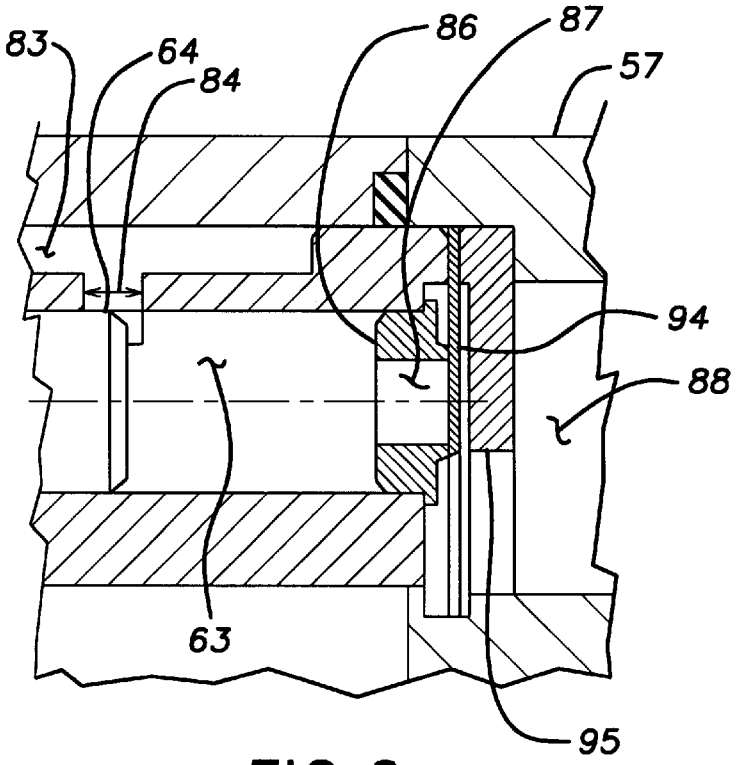
FIG. 6 is an enlarged view of a portion of the piston bore seal of the pump of the present invention.

As best shown in FIGS. 4 and 6, pump body 56 has an inlet passage 79 which is in fluid communication with an annular inlet chamber 83 in piston cylinder 62 that terminates at an orificing slot 84 that establishes an opening in piston bore 63. In the preferred embodiment, slot 84 is opened for some travel distance of piston 64 during the suction stroke and closed during the compression stroke of the piston. In the preferred embodiment, hydraulic fluid at inlet passage 79 is at low pressure (about 20–60 psi) from low pressure pump 23. Fluid flows through orificing slot 84 during the time slot 84 is opened establishing an orifice in fluid communication with piston bore 63. As the speed of the pump increases, the time that slot 84 is opened during the suction stroke of piston 64 decreases. Accordingly, successively smaller quantities of fluid enter piston bore 64 during the suction stroke as pump speed increases to produce a constant flow of fluid from outlet port 90.

Specifically, the variable output of pump 55 is achieved by sizing suction slot 84. Flow is controlled through suction slot 84 by the orifice equation $$Q\,A\cdot\sqrt{\Delta P}\cdot t$$

where "Q" is the flow, i.e., the quantity of fluid flowed for a time through the slot, "A" is the area, "ΔP" is the pressure drop across the slot, and t is the time the slot is open. The maximum displacement is achieved when time is of a magnitude that causes no limitation on the flow, i.e., it is of sufficient duration to fill the piston bore volume. That is to say, for maximum pump displacement the only controlling factors are the size of the orifice and the pressure drop. Time is inversely proportional to pump speed and causes no limitation on flow up to a certain critical or "operating" pump speed. Beyond that critical or operating speed, the flow through slot 84 is limited causing a constant amount of flow regardless of speed.

Figure 8:
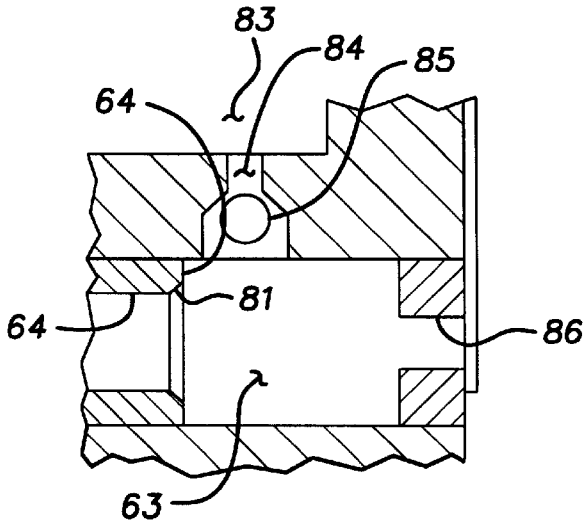
FIG. 8 is a partial sectioned view showing a modification to the suction slot and pump of the preferred embodiment.

In the preferred embodiment, slot 84 is positioned rearwardly in piston bore 63 as shown in FIGS. 4 and 6. However, other arrangements such as shown in FIG. 8 are possible. In FIG. 8, suction slot 84 is positioned forwardly in piston bore 63 and equipped with a ball check valve 85. Slot 84 is thus open for a longer travel distance during the suction stroke of piston 64 than that shown in FIGS. 4 and 6. However, in accordance with the orifice equation above, the size of slot 84 is controlled to produce constant flow over the operating speed. Other slot arrangements will suggest themselves to those skilled in the art. Conceptually, suction slot 84 could be positioned rearward in piston bore 63 so that it is not uncovered by piston 64 and piston could have an orifice opening in its sidewall, fitted with a check valve, allowing fluid to pass through piston 64 to fill piston bore 63 during the suction stroke. All of these arrangements establish an orifice, of a preset size, which is in timed fluid communication with inlet fluid to vary the volume of fluid admitted to pressure bore 63 as a function of pump speed. In contrast, axial piston pumps which do use a stationary swash plate such as the pump disclosed in the '469 patent, maintain fluid communication with the inlet throughout the suction stroke by a feed arrangement which assures filling the piston bore with fluid.

In the embodiment of pump 55 illustrated in FIG. 4, forward end 81 of piston 64 is open and a bleed passage 92 formed in piston ball end 80 provides forced lubrication to slipper/swash plate contact surfaces. Optionally, if pump 55 is not charged with pressurized inlet fluid at inlet 79, internal leakage within pump which collects in body chamber 58 can be routed back to drain through inlet 79 by the provision of an optional drain passage 89 providing fluid communication between body chamber 58 and inlet chamber 83. Pump 55 may not be charged with pressurized inlet fluid in vehicular hydraulic steering applications. In the HEUI system described in FIGS. 1 and 2, pump inlet 79 is at low pressure and pump leakage occurs at front shaft seal 68 which is conventional.

Figure 5:
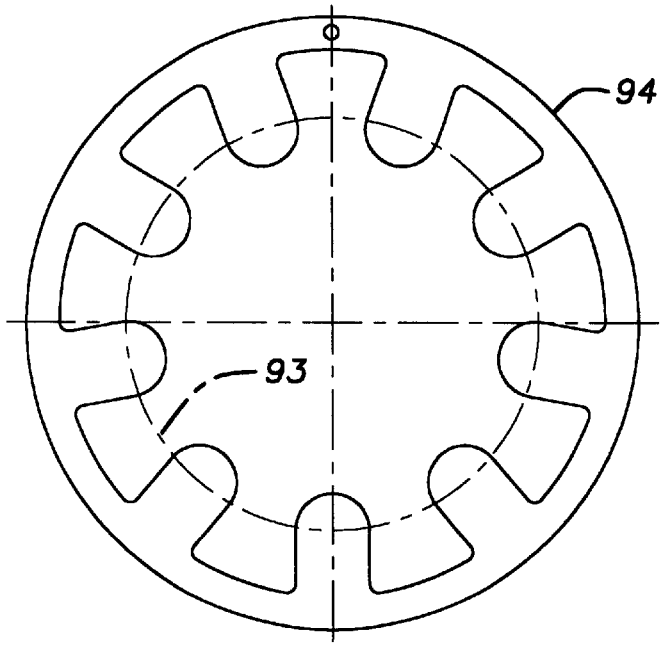
FIG. 5 is a plan view of the reed flapper valve used in the pump.
Figure 9:
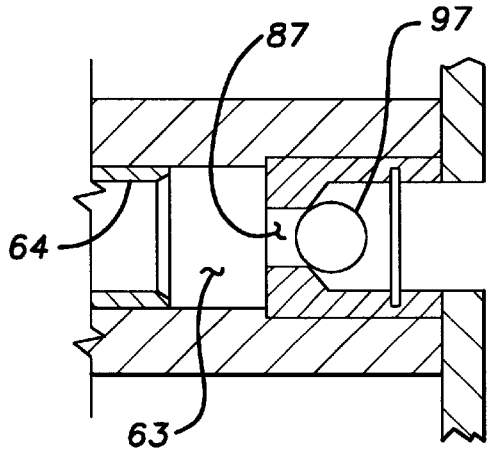
FIG. 9 is a sectioned view showing a modification to the vent orifice of the pump.

As noted, output of fluid from all piston bores 63 is united or unified in annular discharge chamber 88 which has the effect of dampening pulsations attributed to any specific piston 63 during its pressure stroke. In order to prevent back flow of pressurized fluid into piston bores 63 having pistons in a suction stroke travel mode, a check valve is positioned at the outlet of vent orifice 87. In the preferred embodiment, a reed type flapper valve 94, best shown in FIGS. 5 and 6, is positioned at the outlet of vent orifice 87 and held in spaced relationship by a vent plate 95 as shown in detail in FIG. 6. Flapper valve 94 closes when the pressure of the fluid in piston bore 63 is less than the pressure of the fluid in outlet chamber 88. Flapper valve 94 opens when the pressure of the fluid within piston bore 63 equals or exceeds the pressure of the fluid in annular outlet chamber 88. In the preferred embodiment, as shown in FIG. 5, pump 55 has nine piston bores 63 and the relative diameter of discharge chamber 88 is shown by dot-dash circle 93. An alternative to reed flapper valve 94 is a check valve such as ball check valve 97 fitted into vent insert 86 as schematically illustrated in FIG. 9.

Figure 7:
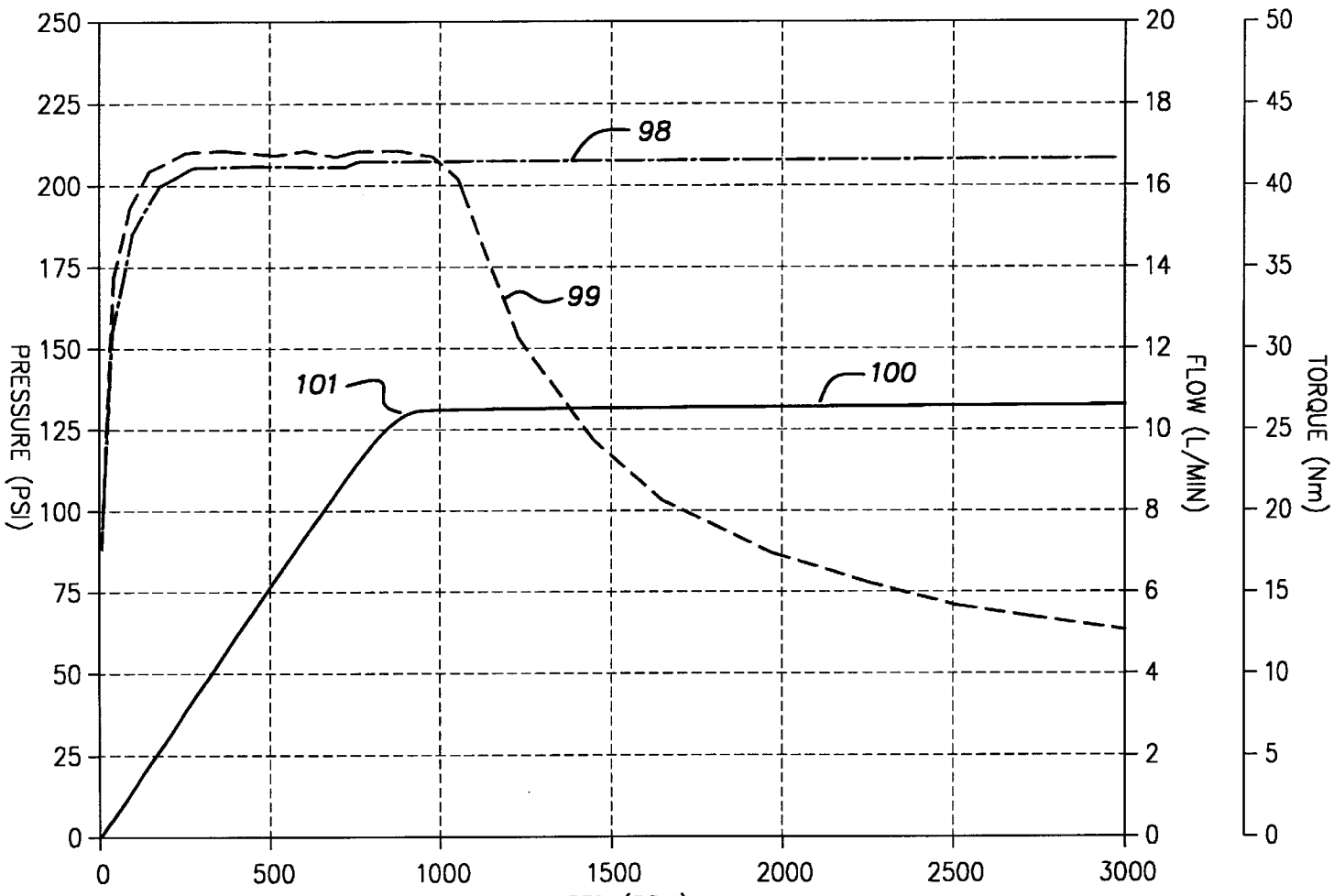
FIG. 7 is a constructed graph showing plots of pump flow, pressure and torque versus speed of the pump used in the present invention.

Reference can now be had to FIG. 7 which is a constructed graph showing performance of the pump design of FIG. 4. Pump pressure is shown as the trace passing through dot dash line indicated by reference numeral 98. Pump torque is shown by the trace passing through dash line indicated by reference numeral 99 and pump flow is shown by the trace passing through solid line indicated by reference numeral 100 at various rotational speeds of shaft 66. FIG. 7 was constructed with inlet pump pressure at one atmosphere and pump fluid at 120° F. As pump speed increases, flow of fluid through suction slot 82 increases with increasing pump speed until a critical or operating speed of the pump is reached whereat a knee 101 is formed in flow curve 100. In the graph of FIG. 7, the flow limiting critical or operating speed of the pump is shown to occur at about 900 rpm. As trace 100 shows, further increase in speed of the pump during this operating range does not result in fluid flow increases. As a matter of definition and as used herein and in the claims, "operating speed" of pump 55 means the speeds at which pump 55 generally produces constant output flow as shown, for example, by trace 100 after knee 101. It should also be noted that torque curve 99 shows torque decreasing with increases in pump speed during the "operating speed" of pump 55. Torque decreases due to the relationship between torque and effective displacement. That is, $$T N \cdot D$$

where "T"=torque, "N"=speed and "D" is effective displacement. Effective displacement of fluid from each piston bore 63 decreases during the suction stroke as explained above. Further, for a constant inlet pressure producing a constant pressure drop, it is possible to control the start of the "operating speed" or knee simply by sizing only the slot area.

Figure 10:
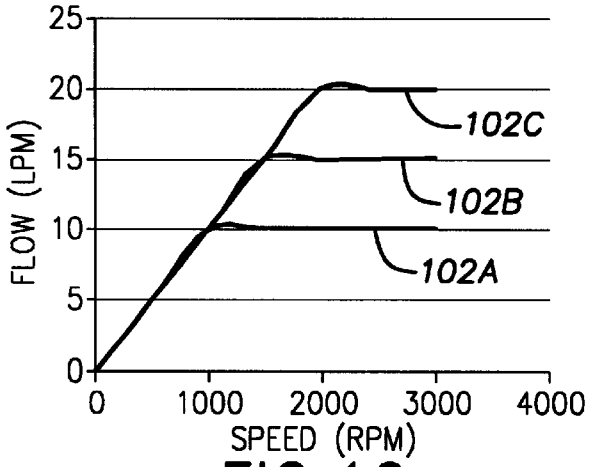
FIG. 10 is a constructed graph showing various flow rates achieved by the pump of the present invention; and, FIG. 11 is a schematic hydraulic circuit of the present invention similar to FIG. 2.

It is also possible to achieve secondary control of variable pump displacement output by controlling the pressure of the fluid at the inlet side of suction slot 82. In the HEUI application, and as noted, low pressure pump typically delivers fluid at inlet 79 at about 20–60 psi. This affects flow through suction slot 82 by the orifice equation set forth above. Changing inlet pressure changes the pressure drop across the orifice and produces a different flow curve. This is best shown by reference to FIG. 10 which shows operating speed flow curves 102A, 102B and 102C. Inlet pressure is constant for each curve but the inlet pressure for curve 102A is less than that for inlet curve 102B which is less than that for inlet curve 102C. In each case, an operating speed is reached whereat constant pump flow occurs but knee 101 at which the pump transitions to its operating (or critical) speed shifts with increasing inlet pressure. FIG. 10 shows that it is possible, by throttling the inlet flow, to variably control the pump's output flow when the pump is within its operating speed range. That is, the output flow of pump 55 at any speed within the pump's operating speed can be controlled by throttling the inlet flow such as shown by curve portion 52 of FIG. 3. Conceptually, placing RPCV 20 upstream of pump 55 can achieve the valving now achieved by RPCV 20 downstream of conventional high pressure pump 32 but without the parasitic power drain of a conventional high pressure pump 32.

Figure 11:
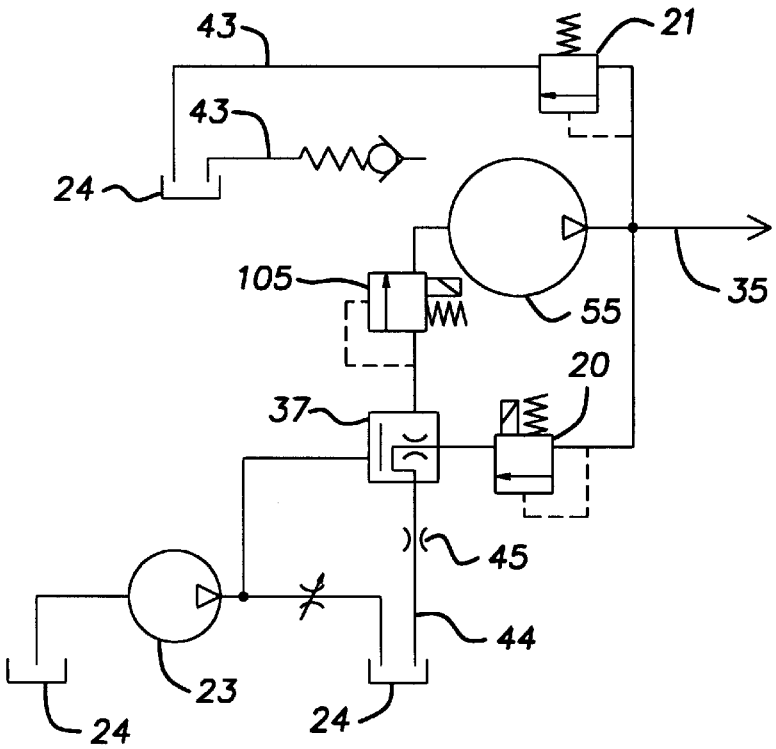

Referring now to FIG. 11, there is shown a portion of the hydraulic circuit shown in FIG. 2 of the prior art modified to incorporate the operating characteristics of pump 55. Components illustrated in FIG. 11 which are functionally similar to the components illustrated and discussed above with respect to prior art FIGS. 1 and 2 will be assigned the same drawing reference numerals as that used in describing the prior art. More particularly, FIG. 11 is characterized by the addition of a solenoid operated throttling valve 105 functionally similar to RPCV 20 and actuated by ECM 18. That is, ECM 18 knows the constant flow of axial piston pump and actuates throttling valve 105 to drop the constant flow to any lesser value. (A throttling valve port shown by reference numeral 106 in FIG. 4 is in fluid communication with inlet port 79.) The constant flow value is set at minimum system flow requirements plus a safety factor required by the system. In the preferred embodiment, RPCV 20 is eliminated from FIG. 11. It is shown in FIG. 11 because of a slight fractional second delay which can elapse from the time throttling valve 105 is actuated to the time the reduced flow appears at pump outlet 90. Some manufacturers may desire a millisecond response so RPCV 20 is shown in FIG. 11. In such instance, ECM has to co-ordinate throttling valve 105 and RPCV 20. A downsized RPCV 20 would be employed and actuated, in theory, for a fractional second until pump output realized the setting of throttling valve 105. Alternatively, RPCV 20 can be eliminated.

The invention has been described with reference to a preferred embodiment. Obviously, alterations and modifications will occur to those skilled in the art upon reading and understanding the Detailed Description of the Invention set forth herein. For example, the invention has been described with reference to a HEUI system where it has particular application. To a similar extent, a steering or hydraulic suspension system on a vehicle has similar considerations and a high pressure pump 55 could be installed in such systems. Typically, those systems would not charge the inlet of pump 55 so drain passage 89 could be provided for internal pump leakage. It is intended to include all such modifications and alterations insofar as they come within the scope of the present invention.

Having thus defined the invention, it is claimed:

1. In an internal combustion engine having a hydraulically-actuated electronically-controlled fuel injection system of the type including a fuel injector valving high pressure fluid in response to commands from an ECM to timely inject a metered quantity of fuel into the engine's combustion chamber; the injector in fluid communication with the outlet of a high pressure pump having an inlet in fluid communication with a low pressure pump; the improvement comprising:

an axial piston, high pressure pump having a plurality of piston bores circumferentially spaced about a longitudinal centerline of the pump; a piston within each cylinder having one end in contact with a swash plate rotatable relative to the cylinder, each piston axially movable in its piston bore to uncover and cover a transversely positioned suction slot of set area formed in the piston bore and pump fluid at its opposite end through a discharge vent opening in the cylinder; a check valve at each discharge vent opening and each discharge vent opening in fluid communication with the pump outlet whereby the flow of fluid pumped by the pump is generally constant throughout the operating range of the pump.

2. The improvement of claim 1 wherein the ECM develops signals controlling the operation of the injector for fuel metering without modifying the flow from the pump outlet to the injector, and the angle between the swash plate and the pistons is fixed throughout the operating speed of the pump.

3. The improvement of claim 2 further including a pressure controlled throttling valve at the inlet of the high pressure pump, the ECM regulating the inlet flow of fluid through the pressure control valve to reduce the flow of fluid to the high pressure pump when predetermined engine conditions are sensed by the ECM.

4. The improvement of claim 3 further including an annular discharge chamber in fluid communication with the discharge orifice and an outlet port of the pump and a reed flapper valve at the outlet of each piston bore's discharge orifice functioning as a check valve, whereby high pressure fluid pumped by all pistons is united in the discharge chamber to dissipate pump pulsations.

5. The improvement of claim 3 further including a rail pressure control valve between the fuel injectors and the high pressure pump outlet under the control of the ECM for varying the flow of pump output fluid to the fluid injectors.

6. The improvement of claim 3 wherein the pump outlet port is in direct unaltered fluid communication with the injectors whereby the output flow of the pump transmitted to the fuel injectors is not varied.

7. The improvement of claim 1 wherein the set area of the slot is determined as a function of the relationship $$Q A \cdot \sqrt{\Delta P} \cdot t$$

where

"Q" is the quantity of fluid flowed through the slot for a time

"A" is the area of the slot

"ΔP" is the pressure drop of the fluid through the slot, and

"t" is the time the slot is open during the suction stroke and the area of the slot is such to limit the flow of fluid into the piston bore at a set time.

8. The improvement of claim 7 wherein the pressure drop through the suction slot is variably controlled after the operating speed of the pump has been reached by variably changing the inlet pressure.

9. In a diesel engine equipped with hydraulically actuated electronically controlled unit fuel injectors having a high pressure pump in fluid communication with a high pressure rail connected to the injectors in turn utilizing solenoids actuated by an ECM to control valving of high pressure pump fluid within the injectors to timely and variable actuate the injectors, the improvement comprising:

a fixed displacement axial piston pump having a substantially constant flow over its operating range in unaltered fluid communication with said high pressure rail whereby an electronically controlled, pressure regulating valve controlling pump pressure in said high pressure rail is alleviated.

10. The improvement of claim 9 further including a safety relief valve in fluid communication with the outlet port of the high pressure pump for maintaining the pressure within said high pressure rail below a set value.

11. The improvement of claim 10 wherein the axial piston pump has a rotatable shaft carrying a rotatable swash plate and a stationary cylinder having a plurality of open ended piston bores circumferentially spaced about said shaft; each piston bore containing an axially movable piston extending through one end of said bore in contact with said swash plate, a suction slot establishing fluid communication through the slot from pump inlet to piston bore during a portion of piston suction stroke travel while preventing fluid communication between piston bore and pump inlet during the compression piston stroke and a discharge vent port at its opposite end in fluid communication with a discharge chamber in turn in fluid communication with a pump outlet port.

12. The improvement of claim 11 further including a reed type flapper valve adjacent and between said pump's orifice and said discharge chamber.

13. The improvement of claim 9 further including a low pressure pump supplying fluid at low pressure to the inlet of the high pressure pump; an electronically actuated pressure control throttling valve at the inlet of said high pressure pump and the throttling valve actuated by the ECM to variably retard the flow of inlet fluid to the high pressure pump.

14. A constant flow, fixed displacement, axial piston pump comprising:

a non-rotatable cylinder containing a plurality of piston bores circumferentially spaced about a longitudinal centerline of the pump;

a rotatable shaft concentric with the longitudinal centerline having a swash plate rotatably affixed thereto;

a piston axially movable within each bore having one end extending through a bore end and journalled in a slipper in sliding contact with the swash plate while the piston's opposite end is adjacent an outlet check valve at the opposite bore end;

the pump having a discharge chamber in fluid communication with all piston check valves and with the pump outlet; and, each piston bore having a suction slot of set area in fluid communication with the pump inlet, the suction slot transversely positioned at a set distance between the piston bore ends and sealed and opened by axial movement of each piston within its bore whereby fluid flow into the piston bore decreases in proportion to increases in shaft rotational speed after the operating speed of the pump has been reached.

15. The pump of claim 14 further including a check valve in the suction slot.

16. The pump of claim 14 wherein each piston is hollow and open at its end adjacent the outlet check valve, each piston having a piston opening positioned between its ends and a piston check valve in the piston opening, the slot in fluid communication with the piston opening for a set piston travel distance during the piston's suction stroke and out of fluid communication with the piston opening during a compression stroke of the piston.

17. The pump of claim 14 wherein the outlet check valve is a reed flapper valve whereby high pressure fluid pumped by all pistons is united in the discharge chamber to dissipate pump pulsations.

18. The pump of claim 17 further including the pump having a housing defining a housing chamber therein; the cylinder fixed to the housing and the shaft journalled in the housing; the housing having an annular inlet chamber in fluid communication with the pump inlet and with the slot opening to the piston bore, and a drain passage in the housing in fluid communication with the housing chamber and the inlet chamber whereby internal pump leakage is drained through the pump inlet when the inlet fluid is not pressurized.

19. The pump of claim 18 further including a throttling valve at the inlet of the pump.

20. The pump of claim 14 wherein the set area of the slot is determined as a function of the relationship $$Q A \cdot \sqrt{\Delta P} \cdot t$$

where

"Q" is the quantity of fluid flowed through the slot for a time

"A" is the area of the slot

"ΔP" is the pressure drop of the fluid through the slot, and

"t" is the time the slot is open during the suction stroke and the area of the slot is such to limit the flow of fluid into the piston bore at a set time.

21. The pump of claim 20 wherein the pressure drop through the suction slot is variably controlled after the operating speed of the pump has been reached by variably changing the inlet pressure.

22. The pump of claim 14 further including a tail shaft extending along the longitudinal centerline of the pump; a spherical bearing mounted to the tail shaft; a retainer plate having a central opening smaller than the outside spherical diameter of the spherical bearing and in contact with the outside spherical surface of the spherical bearing, the retainer plate further having circumferentially spaced openings receiving slippers therein and a spring biasing the spherical bearing towards the swash plate.

* * * * *

UNITED STATES PATENT AND TRADEMARK OFFICE

CERTIFICATE OF CORRECTION

PATENT NO. : 6,227,167 B1
DATED : May 8, 2001
INVENTOR(S) : Brian William Smith et al.

It is certified that error appears in the above-identified patent and that said Letters Patent is hereby corrected as shown below:

Title page,
Item [75], correct Inventor's name from "Mark Douglas Smith" to -- Mark Douglas Correll --

Signed and Sealed this

Thirteenth Day of August, 2002

*Attest:*

*Attesting Officer*

JAMES E. ROGAN
*Director of the United States Patent and Trademark Office*